US007393595B2

(12) United States Patent
Chandrasekaran et al.

(10) Patent No.: US 7,393,595 B2
(45) Date of Patent: Jul. 1, 2008

(54) COMPOSITE COMPRISING A METAL OR ALLOY AND A SHAPE MEMORY ALLOY

(75) Inventors: Lakshman Chandrasekaran, Farnborough (GB); Alan J Shakesheff, Farnborough (GB)

(73) Assignee: Qinetiq Limited, London (GB)

( * ) Notice: Subject to any disclaimer, the term of this patent is extended or adjusted under 35 U.S.C. 154(b) by 514 days.

(21) Appl. No.: 10/498,109

(22) PCT Filed: Nov. 27, 2002

(86) PCT No.: PCT/GB02/05343

§ 371 (c)(1),
(2), (4) Date: Jun. 7, 2004

(87) PCT Pub. No.: WO03/047794

PCT Pub. Date: Jun. 12, 2003

(65) Prior Publication Data

US 2005/0067059 A1 Mar. 31, 2005

(30) Foreign Application Priority Data

Dec. 7, 2001 (GB) ..... 0129311.7

(51) Int. Cl.

| | |
|---|---|
| ***B22F 7/00*** | (2006.01) |
| ***C22F 1/00*** | (2006.01) |
| ***B32B 15/00*** | (2006.01) |
| ***C22C 47/00*** | (2006.01) |

(52) U.S. Cl. ..... 428/614; 428/651; 75/249; 148/535; 148/402; 148/563; 419/5

(58) Field of Classification Search ..... None
See application file for complete search history.

(56) References Cited

U.S. PATENT DOCUMENTS

| | | | | |
|---|---|---|---|---|
| 5,508,116 | A | 4/1996 | Barrett | |
| 5,611,874 | A | 3/1997 | Zadno-Azizi et al. | |
| 6,024,347 | A * | 2/2000 | Grosskrueger et al. | 267/220 |

FOREIGN PATENT DOCUMENTS

| | | | |
|---|---|---|---|
| DE | 29722840 U1 | * | 2/1998 |
| JP | 6-278235 | | 10/1994 |
| JP | 7-48637 | | 2/1995 |
| JP | 07-133743 | * | 5/1995 |

(Continued)

OTHER PUBLICATIONS

Translation of JP 06-278235.*
Translation of JP 08-176702.*
Translation of JP 10-017959.*

(Continued)

*Primary Examiner*—John J Zimmerman
(74) *Attorney, Agent, or Firm*—Nixon & Vanderhye P.C.

(57) ABSTRACT

A composite element comprises:(a) a metal or metal alloy component having an elastic modulus that decreases with increasing temperature in a temperature range; and (b) sufficient amount of a shape memory alloy component having an elastic modulus that shows an increase in elastic modulus with increasing temperature in the said temperature range, such that the elastic modulus of the composite element does not fall substantially as the temperature is increased across the said temperature range. An article comprising such a composite element is suitable for use in high temperature applications, including motor vehicle components.

22 Claims, 2 Drawing Sheets

FOREIGN PATENT DOCUMENTS

| | | | |
|---|---|---|---|
| JP | 07-150369 | * | 6/1995 |
| JP | 8-176702 | | 7/1996 |
| JP | 10-17959 | | 1/1998 |
| JP | 10-146612 | | 6/1998 |
| JP | 10-153185 | * | 6/1998 |
| JP | 2000-104134 | * | 4/2000 |
| WO | WO 99/20357 | * | 4/1999 |

OTHER PUBLICATIONS

Abstract of KR 2002051461.*
Translation of JP 06-278235, no date.*
Translation of JP 08-176702, no date.*
Translation of JP 10-017959, no date.*
Abstract of KR 2002051461, no date.*
Porter et al; "Fatigue and Fracture Behavior of Nickel-Titanium Shape-Memory Alloy Reinforced Aluminum Composites"; Materials Science and Engineering A, Sep. 15, 2001, vol. 314, (1-2), pp. 186-193, XP001145536.

Liaw et al; "Ni-Ti SMA-Reinforced A1 Composites"; JOM, 2000, vol. 52, No. 10, pp. 52-56, XP001145535.

Mizuuchi et al; "Processing of TiPd shape memory alloy reinforced Ti-matrix composites and their mechanical structures", Materials Science and Engineering A316 (2001) 93-101.

Document XP-001145536—Porter, GA (University of Tennessee) et al: "Fatigue and fracture behavior of nickel-titanium shape-memory alloy reinforced aluminum composites". Materials Science and Engineering A (Sep. 15, 2001) 314, (1-2), 186-193, Photomicrographs, Graphs, 10 Ref.. Switzerland Conference: Cyclic deformation and fatigue of solids: An international symposium in honor of Professor Campbell Laird, Nashville.

Document XP-001145535—Wei,ZG, Tang CY, Lee WB "Design and fabrication of intelligent composites based on shape memory alloys", Journal of Materials Processing Technology 69 (1997) pp. 68-74, Department of Manufacturing Engineering, Hong Kong Polytechnic University, Hung Hom, Kowloon, Hong Kong.

* cited by examiner

COMPOSITE COMPRISING A METAL OR ALLOY AND A SHAPE MEMORY ALLOY

This application is the U.S. national phase of international application PCT/GB02/05343 filed in English on 27 Nov. 2002, which designated the U.S. PCT/GB02/05343 claims priority to GB Application No. 0129311.7 filed 07 Dec. 2001. The entire contents of these applications are incorporated herein by reference.

This invention relates to a composite element comprising a metal or metal alloy component in combination with a shape memory alloy component, to a method of making such a composite element, and an article comprising such a composite element.

Metals and metal alloys are sometimes used in applications in which they are exposed, in service, to a wide range of temperatures. One example is high performance motor-sport applications, where various vehicle parts, e.g. brake parts, especially brake calipers, may have to withstand in-service temperatures up to about 260° C., specifically without substantial reduction in elastic modulus as the temperature is increased.

For high performance motor sport applications, the materials must also be low weight, and currently conventional aluminium alloys are used. These have an elastic modulus of about 70 GPa at room, temperature. However, while these are suitable for some classes of motor sport, they are unsuitable for other higher classes of motor-sport vehicles because their elastic modulus is not sufficiently stable, decreasing rapidly at temperatures greater than 150° C. For such high performance motor-sport applications in which a more stable elastic modulus is required, it is known to use particulate reinforced aluminium-alloy composite materials. These materials typically exhibit an elastic modulus in the range 90-110 GPa, and this is stable up to about 200° C. However the elastic modulus of ever these reinforced aluminium alloy composites tends to decrease rapidly at higher temperatures. Also recent changes in regulations governing the motor-sport industry have stipulated that at least for some classes the elastic modulus of materials used must not exceed 80 Ga. This recent regulation effectively precludes the use of the known particulate-reinforced aluminium alloy materials.

Shape memory alloys (SMA) are also well known. An SMA material has the ability to "remember" its shape, i.e. it car undergo an apparent plastic deformation at a lower temperature that can be recovered on heating to a higher temperature. This shape memory effect (SME) is associated with a special group of alloys that undergo a crystal structure change on changing the temperature by a shear movement of atom planes, the higher temperature phase being termed the austenite phase, and the lower temperature phase being termed the martensite phase. These phases are characterised by critical temperatures $A_S$, $A_F$, $M_S$, and $M_F$, where the subscripts S and F denote the start and finish temperatures respectively of the phase transformations M→A on heating and A→M on cooling. Martenisitic transformation can instead be stress-induced In the austenite phase, at a temperature above the $M_S$ temperature. Alloys treated in this way are known as stress-induced martensite (SIM) alloys and typically exhibit superelasticity.

SMA materials are best known for their use in applications which take advantage of (a) the shape change accompanying the martensite-austenite phase change, either in free recovery to cause motion or strain, or in constrained recovery to generate a stress, or (b) in applications which employ the superelasticity achieved by stress-induced martensite (SIM) formation. Specific examples of applications of SMA materials include pipe couplings, actuators in electrical appliances, sensors, surgical tools such as catheters, forceps, remote grips, orthodontic applications as brace wires, dental root implants etc.

Various compositions of SMA are known, but the most commonly used are titanium-nickel alloys.

A SMA/Aluminium composite is known from "Ni—Ti SMA reinforced aluminium composites", by G. A. Porter, P. K. Liaw, T. N. Tiegs and K. H. Wu, published in J. O. M., October 2000. This describes a nickel-titanium shape memory alloy that has been distributed through an aluminium matrix, using powder metallurgy processing. In the composite the aluminium constituted 90 volume percent. The composite was cold rolled at −30° C. to activate the shape memory effect so that when reheated to the austenite phase the SMA was expected to return to its original shape while embedded in the aluminium matrix. It was thought that this action would strengthen the material and improve fatigue resistance. This reference therefore describes a specific application of the SME of SMA materials to achieve improved strength and fatigue resistance.

Another known, but not typically used, property of SMA materials is that they exhibit a modulus change with temperature. This modulus change is associated with the martensite-austenite phase change and occurs with or without any applied deformation of the material in the martensite phase. Thus, for example it is known that a Ni—Ti SMA may show a modulus increase as the temperature increases. The temperature at which this modulus increase begins depends on the $M_S$ temperature of the material, and hence on the specific composition of the SMA. A typical Ni—Ti SMA material may show an increase in modulus from about 55 to 90 GPA from about 0° C. to about 180° C. This modulus increase exhibited by SMA materials is described in "Ni—Ti base Shane Memory Alloys" by K. N. Melton, in "Engineering aspects of Shape Memory Alloys" Eds. T. W. Duerig et al., Butterworth-Heinemann Publication (1990)).

We have discovered that a composite element employing a combination of a metal or metal alloy as a first component and a SMA as a second component can be made that has an elastic modulus that does not fall as the temperature is increased.

A first aspect of the present invention provides a composite element comprising: (a) a metal or metal alloy component having an elastic modulus that decreases with increasing temperature in a temperature range; and (b) sufficient amount of a shape memory alloy component having an elastic modulus that shows an increase in elastic modulus with increasing temperature in the said temperature range such that the elastic modulus of the composite element does not fall substantially as the temperature is increased across the said temperature range.

Where we use the term metal or metal alloy in this specification we mean a conventional metal that does not show the martensite-austenite crystal structure change on changing the temperature associated with a SMA.

Preferably the elastic modulus does not fall by more than 10 GPa as the temperature is increased across the said temperature range. More preferably the elastic modulus does not fall by more than 5 GPa as the temperature is increased across the said temperature range. Most preferably the elastic modulus does not fall at all as the temperature is increased across the said temperature range. The elastic modulus must not fall substantially, but may rise, as the temperature is increased across the said temperature range. However, preferably the nature and relative quantities of the metal or metal alloy and the SMA are chosen such that the elastic modulus of the composite element is substantially stable across the said temperature range, i.e. neither falls substantially nor rises substantially across the said temperature range. In particular preferably the elastic modulus of the composite element varies by at most 25 GPa across the said temperature range. Depending on the application and temperature range, the elastic modulus preferably varies by at most 20 GPa, 15 GPa, 12 GPa or 10 GPa across the said Temperature range.

The elastic modulus measurement may be isotropic for the composite element, or may vary according to the direction of measurement. A non-isotropic variation in elastic modulus of the composite element may result, for example, from a non-uniformly dispersed arrangement of SMA alloy within the metal or metal alloy. Where reference is made to the elastic modulus value, this means the value when measured in at least One direction of the composite element. While a different value of elastic modulus may be measured in other directions, the skilled man would be able to design the manner in which he arranged the composite element in operation in order to take advantage of the controlled elastic modulus in the said at least one direction.

According to the invention the elastic modulus of the metal or metal alloy component decreases, and the elastic modulus of the SMA increases with increasing temperature in the same temperature range, the combination being such that the elastic modulus of the overall composite element does not fall across the temperature range. For preferred embodiments according to the invention the minimum temperature of the said temperature range is at least 20° C. Similarly for preferred embodiments according to the invention the maximum temperature of the said temperature range is at most 400° C. However other narrower temperature ranges within the wide temperature range of 20° C.-400° C. are also preferred for certain applications. For example the minimum temperature of the said temperature range over which the elastic modulus does rot substantially fall may be 150° C., or 260° C. and the maximum temperature of the said temperature range over which the elastic modulus does not substantially fall may be 260° C., 300° C. or 350° C.

Control of the elastic modulus of the composite element is achieved by adding sufficient amount of the SMA. Preferably the shape memory alloy component is present in an amount that is more than 10% by volume based on the overall volume of the composite article. For certain applications larger percentages of SMA may be desirable. For example the shape memory alloy may preferably be present in an amount this is more than 12%, 15%, 20%, 40% or even 60% by volume based on the overall volume of the composite element. In general increasing the volume percentage of SMA increases the extent of the said temperature range over which fall of the elastic modulus is substantially prevented.

The increase in modulus of the SMA material with increasing temperature is thought to be associated with the martensite to austenite phase change, the elastic modulus of the SMA material initially falling with increasing temperature (when in its martensite phase), reaching a minimum cusp at the $M_S$ temperature, and then beginning to rise again with increasing temperature (when in its austenite phase). Preferably the SMA used in the invention is one having a $M_S$ temperature that is either below or just above the minimum temperature of the said specified temperature range. For a particularly preferred embodiment according to the present invention, the $M_S$ temperature of the SMA alloy is preferably in the range 20-30° C., especially about 25° C. We have also found that the absolute value of the elastic modulus of the composite element can be varied by appropriate selection of the SMA. While a SMA having a $M_S$ of 25° C. is most preferred, especially for achieving an absolute elastic modulus that is less than 80 GPA, it is also envisaged that a SMA having a higher $M_S$ transition temperature, e.g. in the range 50-60° C. might be used, especially where a higher absolute elastic modulus is required. In other terms this can be expressed by saying that a preferred SMA for use in the invention is one in which the minimum cusp in the modulus/temperature curve for the material is at 25° C., but by appropriate other selection of SMA material this minimum cusp can be displaced to a higher or lower temperature therefore achieving a different temperature range over which the elastic modulus of the composite element is substantially prevented from falling, and/or a higher or lower absolute modulus value at a desired temperature.

A number of metals or metal alloys would be suitable for use in the composite element. It is especially preferred to use aluminium or an aluminium alloy. This is particularly advantageous for applications where low weight is also desirable in addition to controlled modulus. As other examples of metal alloys that might be particularly useful in the present invention to achieve controlled modulus effects, there may be mentioned magnesium-based or zinc-based alloys.

Similarly any shape memory alley may be used but it is especially preferred to use a nickel/titanium shape memory alloy. A pure nickel/titanium alloy may be used. More usually other materials may be present, e.g. silicon, iron, cooper, manganese, magnesium, chromium.

The composite element comprises both a metal or metal alloy and a SMA. These may be-arranged together in a number of suitable ways. Preferably the shape memory alloy component is at least partly embedded in the metal or metal alloy component. This may be achieved, for example, using a core of the shape memory alloy component and a cover of the metal or metal alloy component. In this case the cover is preferably swaged onto the core. The core of the shape memory alloy component is preferably elongate, and the outer cover of the metal or metal alloy component tubular. For example the core may be a wire core, preferably a central core.

In another example a shape memory alloy component may be provided in the form of a plurality of elongate members embedded in a matrix of the metal or metal alloy component. These may for example take the form of wires or rods of any cross-section-extending in any direction, e.g. in a series of parallel or random directions in the metal or alloy, or may be in the form of a net.

In yet another example the shape memory alloy component may be provided in the form of discrete particles embedded in a matrix of the metal or metal alloy component. These may be relatively large or small. In the latter case, the discrete particles of the shape memory alloy component may have been distributed through the metal or metal alloy component using a powder-metallurgy processing technique. The nature of distribution of the particles in the metal or metal alloy and the processing route would generally be discernible by visual examination or testing of the composite element.

Depending on the application of the composite element its weight may be an important factor. For example for the motor sport applications described above low weight is desirable. For these and other applications, the composite element preferably has a maximum density of at most 4.5 gcm-3.

As mentioned above, in general increasing the volume percentage of SMA increases the extent of the said temperature range over which fall of the elastic modulus is substantially prevented. However increasing the volume percentage of SMA may also increase the overall density of the composite material. This depends on the selection of materials for the metal and the SMA but is usually the case when, as preferred, the metal or metal alloy comprises aluminium. Therefore the choice of the optimum volume percentage of SMA is a trade-off of maximising the temperature range over which the fall of elastic modulus is substantially prevented, while minimising the density. For preferred composite elements according to the present invention this trade-off is preferably achieved by using a composite element having a volume fraction of SMA in the range 20-25 percent, preferably about 23 percent.

The composite element according to the invention takes advantage of the increasing elastic modulus of a SMA with increasing temperature, but-does not use the SME (shape memory effect) normally used in elements incorporating SMAs. Since the SME is not used, the composite element according to the invention does not need to be, and is therefore preferably not, deformed during its manufacturing process at a temperature below $M_S$ of the shape memory alloy component. Thus, the composite element ay contain a shape memory alloy component that has not been treated to enable it to exhibit shape memory behaviour in the future, or, so that it already exhibits the results of such behaviour (e.g. residual stresses, or a length change).

The combination of a metal or metal alloy with a SMA that has not been deformed below the $M_S$ temperature is novel per se, regardless of the elastic modulus behaviour of the resulting composite. Therefore a second aspect of the present invention provides a composite element comprising a metal or metal alloy component and a shape memory alloy component, the metal or metal alloy component having an elastic modulus that decreases with increasing temperature in a temperature range, and the shape memory alloy component having an elastic modulus that shows an increase in elastic modulus with increasing temperature in the said temperature range, wherein the composite element has not been deformed during its manufacturing process at a temperature below $M_S$ of the shape memory alloy component.

A third aspect of the invention provides an article comprising a composite element according to the invention. Preferably the article is one for use at high in-service temperatures up to at least 260° C., or even 300° C., 350° C. or 400° C. In a particularly preferred embodiment the article is suitable for use in a motor sport vehicle, especially for use as part of a vehicle brake, e.g. as a brake caliper. The said temperature range over which the elastic modulus of the composite element does-not substantially fall according to the invention is preferably the operating or in-service temperature range seen in use by the article.

A fourth aspect of the present invention provides a method of making a composite element, comprising (i) providing (a) a metal or metal alloy component having an elastic modulus that decreases with increasing temperature in a specified temperature range, and (b) sufficient amount of a shape memory alloy component having an elastic modulus that shows an increase in elastic modulus in the specified temperature range such that the elastic modulus of the composite element does not fall substantially over the said temperature range; and (ii) at least partially embedding the shape memory alloy component in the metal or metal alloy component.

A fifth aspect of the invention provides a method of making a composite element, comprising (i) providing (a) a metal or metal alloy component having an elastic modulus that decreases with increasing temperature in a specified temperature range, and (b) a shape memory alloy component having an elastic modulus that shows an increase in elastic modulus in the specified temperature range, and (ii) at least partially embedding the shape memory alloy component in the metal or metal alloy component;

wherein the method does not include deforming the composite element at a temperature below $M_S$ of the shape memory alloy component.

It will be evident from the foregoing that a process for making either a composite element, or an article, for use in a high temperature environment (e.g. temperatures exceeding 100° C., and usually at least 200° C.) may involve, as a crucial step, selecting a shape memory alloy component having a suitable composition and $M_S$ temperature (e.g. in the range 10°-40° C., preferably 20-30° C.), in a suitable volume percent, so that the element or article exhibits the desired elastic modulus behaviour.

Preferred aspects of the composite element according to the invention as described above also apply to the methods of making the composite element according to the invention.

The invention will now be illustrated with reference to the following examples, which refer to the accompanying drawings, in which.

EXAMPLES

Ten composite elements according to the present invention were made by providing a shape memory alloy component in the form of wires of different diameter, and positioning each wire within a tube of an aluminium alloy and swaging the aluminium alloy tube onto the central SMA wire at room temperature. The SMA wires with the martensitic/austenitic transformation temperature $M_S$ of about 25° C. and an expected minimum elastic modulus value at about 25° C. were specially purchased and on receipt specimens were prepared for thermal analysis using differential scanning calorimetry to confirm that the material displayed the desired microstructural characteristics.

SMA wires of 2.6 mm, 3 mm and 4 mm diameter were used, and different diameters of aluminium alloy tube, the combinations of aluminum alloy tubing and central SMA wire diameter being chosen to produce a set of coaxially reinforced SMA/Al-alloy composite elements having a volume fraction of SMA to Aluminium alloy in the range 17% to 65%. The outer diameter of both the SMA wire and the alloy tube of the fabricated composite element (i.e. after the swaging operation) were measured to calculate the volume fraction of the SMA.

The SMA component used in each of the composite elements was a nickel-titanium SMA comprising 44.1 weight percent Nickel and 55.9 weight percent Titanium. As noted above, it had an $M_S$ temperature of about 25° C. The differential canning calorimetry test on the as-supplied SMA alloy wire (2.6 mm sample) confirmed that the austenitic-martensitic transformation occurred within the temperature range 20° C. to −10° C., and the reverse martensite-austenite transformation occurred in the interval 45° C. to 72° C.

Figure 1:
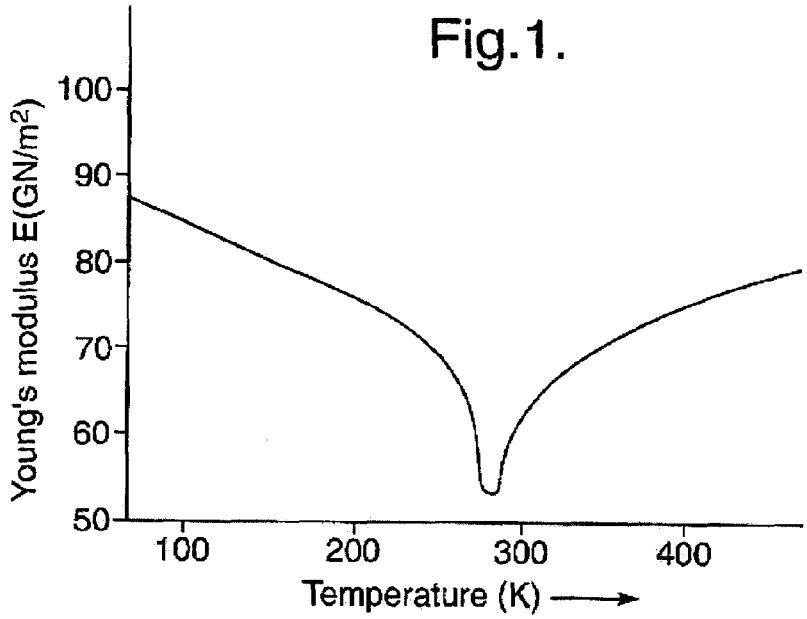
FIG. 1 is a graph showing the elastic modulus/temperature curve of a Ni—Ti SMA of the type used in the composite elements of the examples.

The variation of elastic modulus with temperature of an SMA material of the type and composition used in the test samples is shown by the graph in FIG. 1. This Figure is taken from "Ni—Ti based Shape Memory Alloys" by K. N. Melton in "Engineering aspects of Shape Memory Alloys" Eds T. W. Duerig et al. The actual modulus/temperature curve of the SMA of the samples actually used might vary slightly from that shown in FIG. 1 due to processing variables in SMA manufacture. As can be seen from the Figure, the modulus initially falls to the minimum cusp value, and then rises with increasing temperature, from a minimum value of about 55 GPa at the minimum cusp temperature to a maximum value of about 75 GPa at 450K (177° C.)

The aluminium alloy component used in each of the examples is designated as 6061/T6. This is a standard aluminium alloy having the composition set out in Table 1 below. The variation of the elastic modulus with temperature of the aluminium alloy is shown as one of the curves in FIG. 4. As can be seen it is at its maximum at room temperature, but starts to fall rapidly after the temperature is increased above 150° C.

TABLE 1

| | Composition of Aluminium Alloy | | | | | | | | |
|---|---|---|---|---|---|---|---|---|---|
| | Si | Fe | Cu | Mn | Mg | Cr | Zn | Ti | Al |
| wt % | 0.4-0.8 | 0.7 | 0.1-0.4 | 0.15 | 0.8-1.2 | 0.04-0.35 | 0.25 | 0.15 | balance |

The "T6" reference in the 6061/T6 aluminium alloy designation refers to the standard heat treatment process for this alloy.

The formed composite elements were examined after fabrication using optical microscopy to ensure that the aluminium tubing was intimately in contact with the SMA reinforcing wire. This examination showed that swaging proved to be a successful method for producing unidirectional, coaxial SMA wire reinforced aluminium composites, and that intermediate annealing was not required during the swaging operation.

Then test samples, 150 mm in length, were cut from each of the swaged composite elements, heat treated according to the known T6 process for 20 minutes at 525° C., cold water quenched and then aged at 175° C. for 8 hours, the ageing process being mainly to restore the properties of the aluminium matrix alloy and to remove any residual stresses in the SMA following the swaging process.

The elastic modulus of each of the test composite element samples was determined at room temperature (20° C.) using a dual averaging extensometer with a gauge length of 20 mm to measure strain. The samples were arranged so that the modulus measurement was made in the axial direction of each of the coaxial SMA wire-reinforced composite samples. Testing was performed by repeatedly loading and unloading the samples (a minimum of five times) to just below the elastic limit of the composite material. For comparison the elastic moduli of a Al6061 aluminium alloy test sample, in the T6 heat treated conditions, and without any SMA present (example 11), and of SMA alloy test samples of different diameter, with no aluminium alloy present (example 12) were also determined at room temperature using the same method. The results elastic modulus testing are shown in Table 2 below.

TABLE 2

| | Elastic Modulus Testing at Room Temperature | | | | | |
|---|---|---|---|---|---|---|
| | Before swaging | | After Swaging | | | |
| | Al alloy | | | | | |
| Example Number | tube dimensions mm (OD/ID) | SMA wire diameter Mm | Al alloy tube dimensions mm (OD) | SMA wire diameter mm | % SMA | Average elastic modulus GPa |
| 1 | 7.9/4.0 | 2.6 | 6.25 | 2.6 | 17.31 | 65.6 |
| 2 | 7.9/4.0 | 2.6 | 6.25 | 2.6 | 17.31 | 63.2 |
| 3 | 7.9/4.0 | 3.0 | 6.2 | 3.0 | 23.41 | 65.3 |
| 4 | 6.15/2.8 | 2.6 | 5.0 | 2.55 | 26.01 | 55.5 |
| 5 | 6.2/3.7 | 2.6 | 4.85 | 2.5 | 26.57 | 57.0 |
| 6 | 6.2/4.2 | 2.6 | 4.7 | 2.55 | 29.44 | 62.8 |
| 7 | 6.2/4.2 | 3.0 | 5.024 | 2.78 | 30.62 | 69.4 |
| 8 | 7.9/4.2 | 4.0 | 6.2 | 3.95 | 40.59 | 45.6 |
| 9 | 6.2/4.2 | 4.0 | 4.95 | 4.0 | 65.30 | 43.5 |
| 10 | 6.2/4.2 | 4.0 | 4.95 | 4.0 | 65.30 | 53.4 |
| 11* | Solid Al alloy | — | — | — | 0.0 | 70.0 |
| 12* | — | Solid SMA | — | — | 100.0 | 41.0-54.0 |

*Comparative Examples

The elastic modulus of certain of the test samples (examples 3, 8, 9/10 and 11) was also determined at elevated temperatures, specifically at 150° C., 260° C., 300° C., 350° C., and 400° C. Tensile testing at elevated temperatures was carried out by standard tensile testing methods, using a single sided water cooled transducer extensometer with a gauge length of 25 mm to measure strain. Again the elastic modulus of the test samples was measured, in the axial direction, by repeatedly loading and unloading the samples (a minimum of five times) to just below the elastic limit of the composite material. As before, for comparison the elastic modulus of a Al6061 aluminium alloy test sample, in the T6 heat treated conditions, and without any SMA present (example 11), was also determined at the same elevated temperatures using the same tensile testing method. The results are shown in Table 3 below, the results for room temperature testing from Table 2 having been copied into Table 3 for easy comparison. In Table 3 approximate values for % SMA are given, as can be seen by comparison with Table 2.

TABLE 3

Elastic Modulus Testing over a range of Temperatures

| Ex. No | Material | Measured density gcm-3 | Average elastic moduli measured at different test temperatures (GPa) 20° C. | 150° C. | 260° C. | 300° C. | 350° C. | 400° C. |
|---|---|---|---|---|---|---|---|---|
| 11* | 6061 alloy T6 | 2.7 | 70.0 | 69 | 50.6 | 41.2 | 34.6 | 23.6 |
| 3 | 6061 + 23% SMA | 3.43 | 65.3 | 73.5 | 68.2 | 66.2 | 60.8 | 58.9 |
| 8 | 6061 + 41% SMA | 3.78 | 45.6 | 74.6 | 70.4 | 69.6 | 66.4 | 56.4 |
| 9/10 | 6061 + 65% SMA | 4.44 | 43.5/53.4 | 75.8 | 74.2 | 71.2 | 72.7 | 65.3 |

*Comparative Example

Test samples 1, 2, and 4-7 were not tested at elevated temperatures, but it is expected that their elastic modulus would follow a similar pattern at elevated temperatures to tested samples of similar SMA content.

Figure 2:
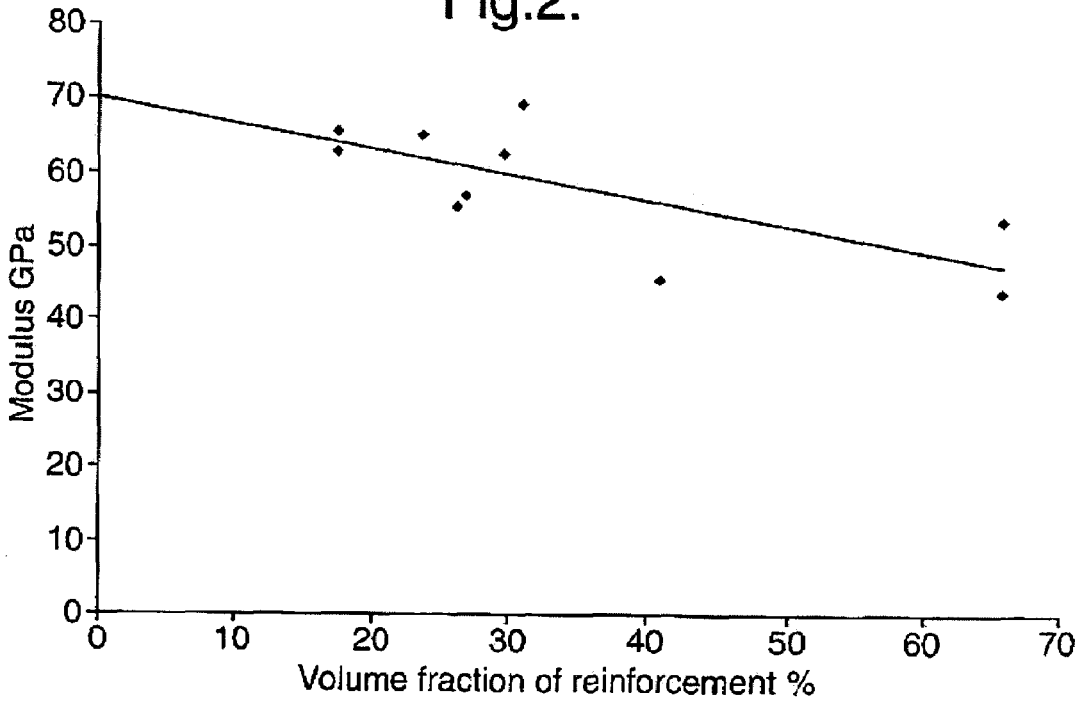
FIG. 2 is a graph showing the effect of SMA volume fraction on the elastic modulus of composite elements of the examples, as measured at room temperature.

From Table 2 it can be seen that room temperature testing on the different test samples shows that the elastic modulus tends to decrease with increasing SMA volume fraction. This is also illustrated graphically in FIG. 2.

From Table 3, it can be seen by looking at the elastic modulus measurements for the comparative pure aluminium alloy sample (example 11) that up to 150° C. the elastic modulus is almost unaffected by temperature, but at 260° C. the elastic modulus is already decreased from 70 GPa to 50.6% Pa. Furthermore, at higher temperatures the modulus decreases more rapidly, reaching a minimum value of 24 GPa at 400° C. In contrast the elastic modulus of the composite samples containing volume fractions of SMA of 23%, 41% and 65% does not decrease at all at temperatures up to 260° C., nor even at temperatures up to 300° C. For example at 260° C. the aluminium alloy (example 11) exhibits a modulus of 50.6 GPa, while the composite sample containing 23 vol % SMA (example 3) exhibits a modulus of 68.2 GPa; higher modulus values being realised in the higher volume percent SMA samples (examples 8 and 9/10). Even at higher temperatures of 350° C. and 400° C., the composite samples show only a slight fall in elastic modulus value when compared to their modulus value at room temperature.

It will be seen from Table 3 that the room temperature measurements of the moduli of test sample examples 8 and 9/10 (41 and 65 vol % SMA respectively) vary between about 43 and 53 GPa, which is considerably lower than the modulus of the aluminium alloy. It is thought that these low values are anomalous. It is well known that slight changes in SMA alloy composition and processing conditions displace the transformation temperatures thereby effectively increasing or (in this case) decreasing the modulus at ambient temperature.

Regardless of the above mentioned anomaly, it is clear that using the SMA/Al-alloy composite materials, a modulus value in the range 65-76 GPa can be achieved across the temperature range 150° C.-300° C., i.e. a modulus similar to that of the aluminium alloy at room temperature (70 GPa). Also it can be seen that in this temperature range (150° C.-300° C.), and indeed over the entire temperature range 20° C.-300° C., the maximum fall in the elastic modulus of any particular example is at most 7.3 GPa (example 3), i.e. less than 10 GPa. This is to be compared to a fall in modulus of 27.8 GPa over the same temperature range for the aluminium alloy used alone (example 11). Even at higher temperatures of 350° C. and 400° C. it can be seen that the further fall in elastic modulus is only slight for the composite samples. In fact in the extended temperature range (150° C.-400° C.), and indeed over the entire temperature range 20° C.-400° C., the maximum fall in the elastic modulus of any particular example is at most 18.2 GPa (example 8), i.e. less than 20 GPa. This is to be compared to a fall in modulus of 45.4 GPa over the same temperature range for the aluminium alloy used alone (example 11). Furthermore even given the probably anomalous room temperature measurements, the variation in elastic modulus over the entire temperature range (20° C.-400° C.) is at most 21.8 GPa (example 9/10) for the composite samples, i.e. less than 25 GPa. This is to be compared to a variation in elastic modulus over the entire temperature range (20° C.-400° C.) of 46.4 GPa for the aluminium alloy used alone (example 11). From Table 3 it can also be seen-that at 400° C. the elastic modulus of each of the composite test samples is at least 50% higher, actually at least 25 GPa higher than the elastic modulus of the aluminium alloy sample (example 11).

Figure 3:
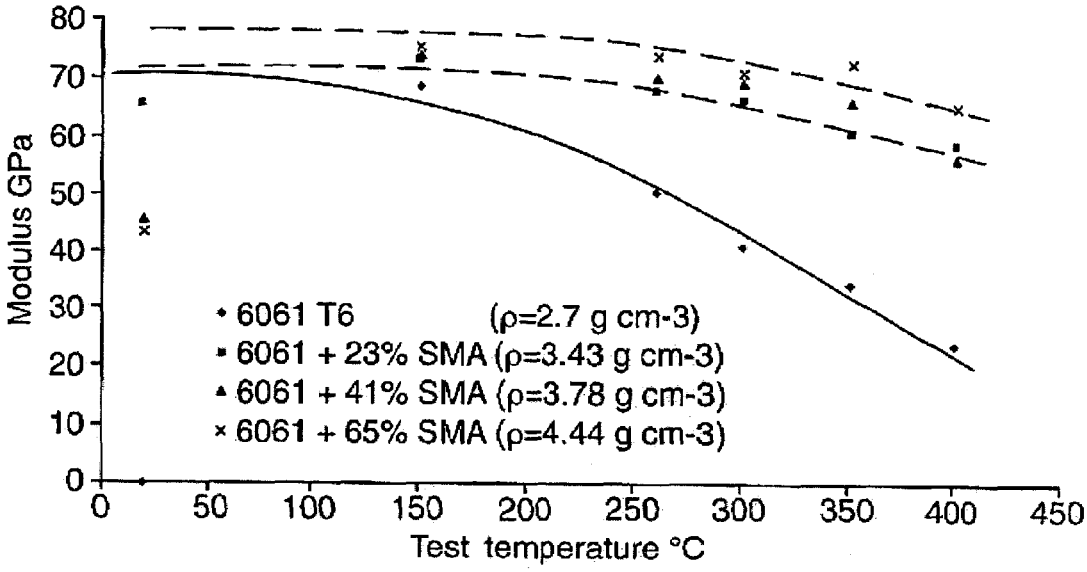
FIG. 3 is a graph showing the elastic modulus/temperature curves for various composite elements according to the examples and for the aluminium alloy component of the composite elements of the examples.

The results of Table 3 are also illustrated graphically in FIG. 3.

From the results in Table 3, and from FIG. 3, it can be seen that the composite materials of examples 3, 8, 9 and 10, and by implication the composite materials of any of examples 1-10 have a substantially stable elastic modulus at elevated temperatures up to 260° C., and even at high temperatures up to 300° C., 350° C. and 400° C. It can also be seen that the absolute value of elastic modulus is less than 80 GPa. Therefore the specific composite materials would be well suited to the high performance motor sport applications described earlier in this specification. For these motor sport applications, not only modulus but also weight is critical. Considering the density values for the composite given in Table 2 it can be seen that increasing the SMA volume percent increases the density and hence the weight of any made part. Thus for the motor sport applications the best selection of composite material is example 3, containing 23 volume percent SMA, since this achieves good elastic modulus stabilisation while having a lower density than the other tested samples. More generally it is expected that a composite comprising the SMA in a volume percent in the range 20-26% would be especially preferred for the motor sport application.

The effect of temperature increase from 20° C. to 400° C. on the elastic modulus of the SMA alloy composite containing 23 volume percent SMA (example 3) was also compared against the effect of temperature increase over the same temperature range on the elastic modulus of the following comparative prior art materials:

(a) Wrought 2618 T6 (2.3% Cu, 1.6% Mg, 1.0% Ni, 1.1% Fe, 0.7% Ti, 0.18% Si, balance Al—all weight percents;
(b) Alloy (a) above reinforced with 20 wt % $Al_2O_3$ by a casting process by Duralcan;
(c) 17% Silicon carbide reinforced 2124 Aluminium alloy (4.5% Cu, 0.6% Mn, 1.5% Mg, balance Al) produced via a powder metallurgy technique by Aerospace Metal Composites; and
(d) 25% Silicon carbide reinforced 2124 Aluminium alloy (as in (c) above).

Alloy (a) is an alloy often used for high temperature applications, and alloys (b), (c), and (d) are examples of the particulate reinforced aluminium alloy composite materials of the type described in the introduction to the present specification.

Figure 4:
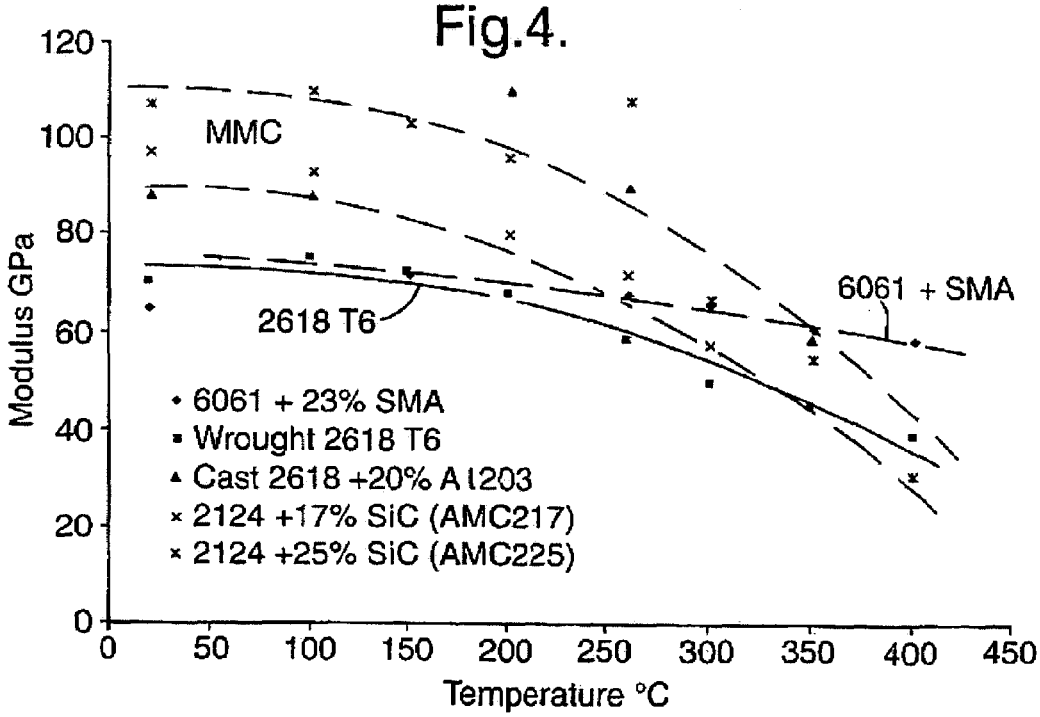
FIG. 4 is a graph showing the elastic modulus/temperature curve for the 6061 aluminium alloy+23% SMA composite shown in FIG. 3 and three comparative conventional materials.

The results of the modulus testing are set out in graphical form in FIG. 4. From this Figure it can be seen that the wrought 2618 alloy (a) (shown by square data points) has a modulus similar to the composite sample according to the invention (shown by diamond data points) at room temperature, but that the modulus of the wrought 261 alloy falls at temperatures higher than 150° C. Similarly although the conventional metal matrix composite materials (alloy (b)—shown by triangular data points, alloy (c) shown by "x" data points and alloy (d) shown by "★" data points) exhibit significantly higher modulus values at temperatures up to 260° C., their modulus decreases rapidly at higher temperatures to values similar to the wrought 2618 alloy (a) at 400° C. The alloy according to the invention has a modulus which falls far less at these higher temperatures.

The invention claimed is:

1. A composite element comprising: (a) a metal or metal alloy component having an elastic modulus that decreases with increasing temperature within the temperature range 20° C.-260° C.; and (b) sufficient amount of a shape memory alloy component, which has a $M_s$ temperature in the range 10° C. to 40° C., and shows an increase in elastic modulus with increasing temperature in the said temperature range, such that the elastic modulus of the composite element does not fall substantially as the temperature is increased across the said temperature range.

2. A composite element according to claim 1 wherein the elastic modulus of the composite element does not fall substantially as the temperature is increased across the temperature range 20° C.-260° C. and further wherein, if the temperature is additionally increased up to 400° C., then the fall in elastic modulus of the composite element is less than 20GPa across the temperature range of 20° C.-400° C.

3. A composite element according to claim 1 wherein the elastic modulus of the composite element does not fall substantially as the temperature is increased across the temperature range 20° C.-260° C. and further wherein, if the temperature is additionally increased up to 300° C., then the fail in elastic modulus of the composite element is less than 10GPa across the temperature range of 20° C.-300° C.

4. A composite element according to claim 1, wherein the shape memory alloy component is present in an amount that is more than 10% by volume based on the overall volume of the composite article.

5. A composite element according to claim 1, wherein the SMA has a $M_s$ temperature in the range 20° C. to 30° C.

6. A composite element according to claim 5, wherein the $M_s$ temperature is about 25° C.

7. A composite element according to claim 1, wherein the metal is aluminum or the metal alloy comprises aluminum.

8. A composite element according to claim 1, wherein the shape memory alloy is a nickel/titanium shape memory alloy.

9. A composite element according to claim 1, wherein the shape memory alloy component is at least partly embedded in the metal or metal alloy component.

10. A composite element according to claim 9, comprising a core of the shape memory alloy component and a cover of the metal or metal alloy component.

11. A composite element according to claim 10, wherein the cover is swaged onto the core.

12. A composite element according to claim 10, comprising an elongate core of the shape memory alloy component, and an outer tubular cover of the metal or metal alloy component.

13. A composite element according to claim 9, wherein the shape memory alloy component is provided in the form of a plurality of elongate members embedded in a matrix of the metal or metal alloy component.

14. A composite element according to claim 9, wherein the shape memory alloy component is provided in the form of discrete particles embedded in a matrix of the metal or metal alloy component.

15. A composite element according to claim 14, wherein the discrete particles of the shape memory alloy component have been distributed through the metal or metal alloy component using a powder-metallurgy processing technique.

16. A composite element according to claim 1, having a maximum density of at most 4.5 $gcm^{-3}$.

17. A composite element according to claim 1, that has not been deformed during its manufacturing process at a temperature below $M_s$ of the shape memory alloy component.

18. A method of making a composite element comprising: (a) a metal or metal alloy component having an elastic modulus that decreases with increasing temperature within the temperature range 20° C.-260° C.; and (b) sufficient amount of a shape memory alloy component, which has a $M_s$ temperature in the range 10° C. to 40° C., and shows an increase in elastic modulus with increasing temperature in the said temperature range, such that the elastic modulus of the composite element does not fall substantially as the temperature is increased across the said temperature range, said method comprising (i) providing (a) a metal or metal alloy component having an elastic modulus that decreases with increasing temperature within the temperature range 20° C.-260° C., and (b) sufficient amount of a shape memory alloy component, which has a $M_s$ temperature in the range 10° C. to 40° C., and which shows an increase in elastic modulus in the specified temperature range, such that the elastic modulus of the composite element does not fall substantially over the said temperature range; and (ii) at least partially embedding the shape memory alloy component (b) in the metal or metal alloy component (a).

19. A method according to claim 18, comprising providing the shape memory alloy component as a core, and positioning the metal or metal alloy component as a cover around the core.

20. A method according to claim 19, wherein the shape memory alloy component is provided as an elongate core, and the metal or metal alloy component is provided as a tubular cover that is positioned around the core.

21. A method according to claim 19, comprising the additional step of swaging the cover onto the core.

22. A method according to claim 18, wherein the metal or metal alloy component and the shape memory alloy component are each provided as a powder, and the step of embedding the shape memory alloy component in the metal or metal alloy component comprises a powder metallurgy process.

* * * * *